US006473077B1

(12) United States Patent
Takenaka et al.

(10) Patent No.: US 6,473,077 B1
(45) Date of Patent: Oct. 29, 2002

(54) DISPLAY APPARATUS

(75) Inventors: Atsushi Takenaka, Machida; Mitsuru Ikezaki, Sagamihara, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/396,849

(22) Filed: Sep. 15, 1999

(30) Foreign Application Priority Data

Oct. 15, 1998 (JP) ..... 10-294245

(51) Int. Cl.[7] ..... G09G 3/36
(52) U.S. Cl. ..... 345/209; 345/92; 345/100
(58) Field of Search ..... 345/100, 132, 345/204, 209, 67, 92; 365/201; 315/169

(56) References Cited

U.S. PATENT DOCUMENTS

| | | | | |
|---|---|---|---|---|
| 4,691,144 A | * | 9/1987 | King et al. | 315/169.3 |
| 5,249,152 A | * | 9/1993 | Malik et al. | 365/201 |
| 5,844,539 A | * | 12/1998 | Kitagawa | 345/100 |
| 6,195,072 B1 | * | 2/2001 | Iwami et al. | 345/67 |
| 6,211,865 B1 | * | 4/2001 | Hosoi et al. | 345/204 |
| 6,236,388 B1 | * | 5/2001 | Iida et al. | 345/132 |

FOREIGN PATENT DOCUMENTS

| | | |
|---|---|---|
| JP | 04-204628 | 7/1992 |
| JP | 04-255822 | 9/1992 |
| JP | 04-309995 | 11/1992 |
| JP | 05-061436 | 3/1993 |
| JP | 9006289 | 1/1997 |
| JP | 9009180 | 1/1997 |
| JP | 9127917 | 5/1997 |

* cited by examiner

*Primary Examiner*—Steven Saras
(74) *Attorney, Agent, or Firm*—F. Chau & Associates, LLP

(57) ABSTRACT

To prevent the display image from becoming unclear due to an overlap of the afterimage of the display image of the preceding frame period with the display image of the current frame period so that the image quality of the motion picture may be improved, a display apparatus includes a display surface having a plurality of pixel lines and a write circuit adapted to sequentially write an image into each of said plurality of pixel lines. The write circuit writes, during a time period for writing said image into at least one pixel line, a black color into another pixel line. The another pixel line is separated from the at least one pixel line by a predetermined distance. The write circuit writes the black color into a plurality of pixel lines separated from the at least one gate line by the predetermined distance.

17 Claims, 13 Drawing Sheets

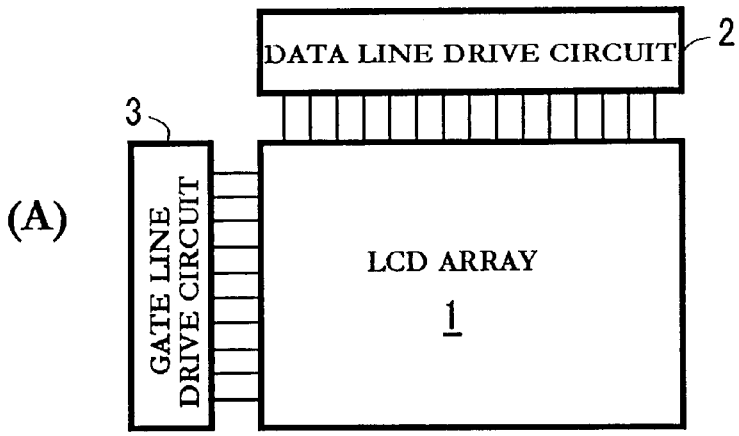
FIG. 1
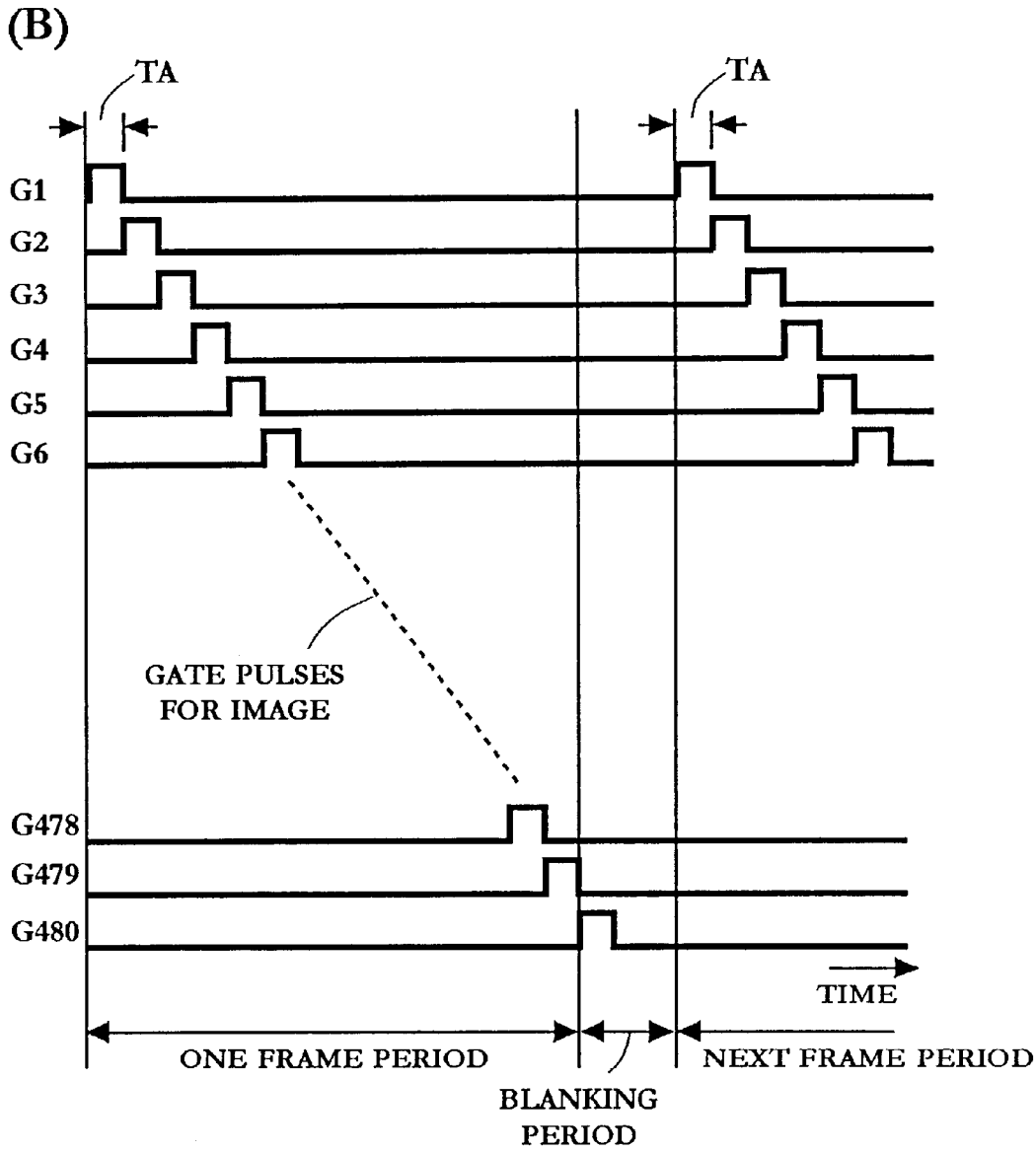

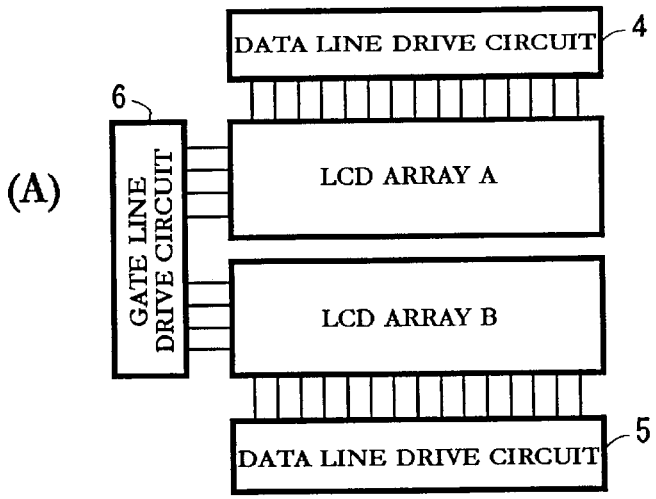
FIG. 3
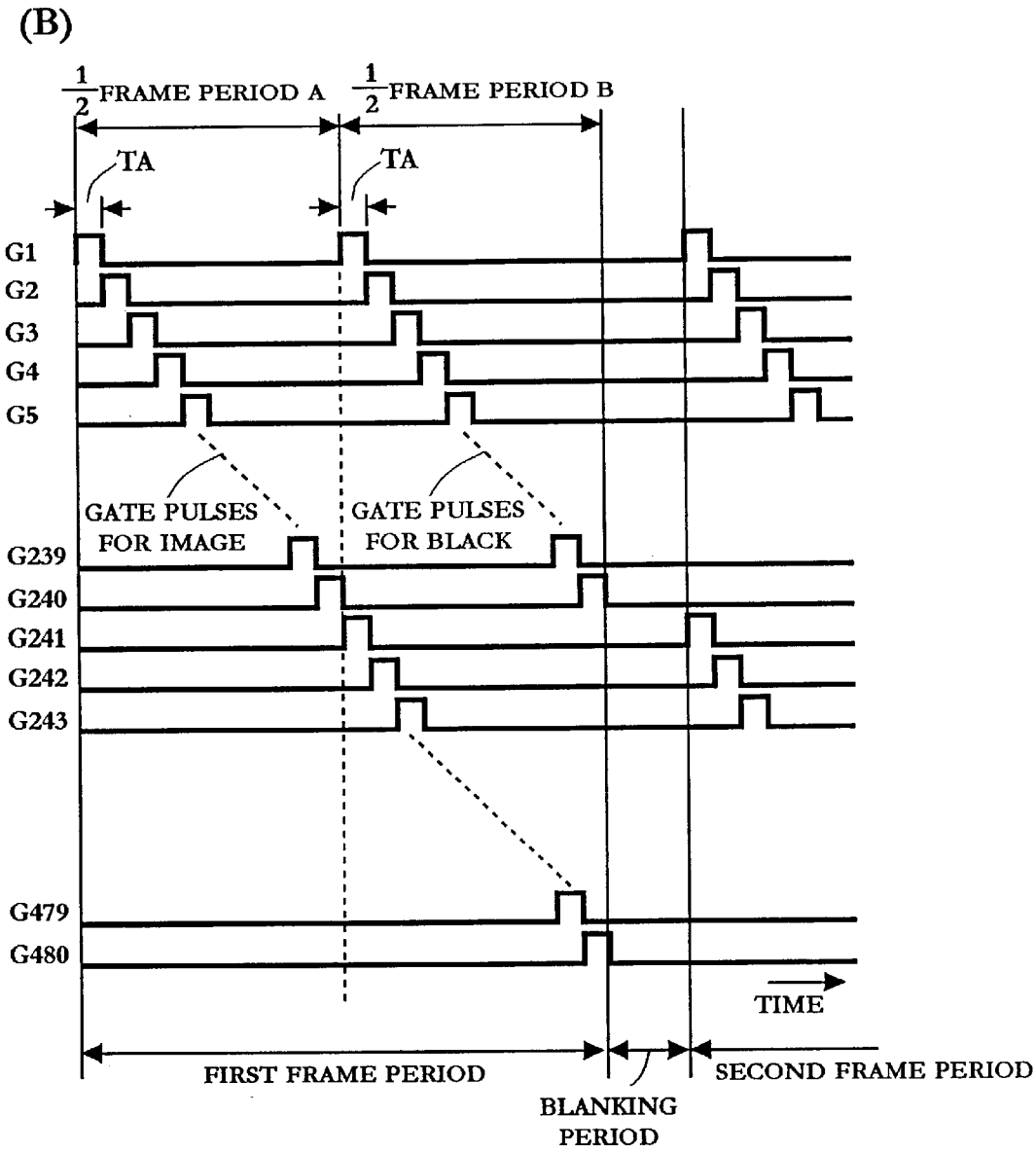

DISPLAY APPARATUS

BACKGROUND OF THE INVENTION

1. Field of the Invention

The present invention relates to a display apparatus, such as a liquid crystal display (LCD) device, a plasma display device, a field emission display device, with a high response speed which can prevent the display image from becoming unclear due to an overlap of the afterimage of the display image of the preceding frame period with the display image of the current frame period to improve the image quality of the motion picture.

2. Discussion of the Related Art

The LCD device with the high response speed, such as a Bend-mode LCD device well known in the art, has been used for improving the image quality of the motion picture in which the displayed image is changed at a high speed. Describing problems in the high response speed LCD device with reference to FIGS. 1(A) and (B), the FIG. 1(A) shows a schematic configuration of a prior LCD device, which includes a LCD array 1, a data line drive circuit 2 and a gate line drive circuit 3. For example, the LCD array 1 has 640×480 pixels of VGA (Video Graphic Array) scheme. In this case, the data line drive circuit 2 supplies the image data to the 640 data lines connected to the 640 pixels of one pixel line, respectively, and the gate line drive circuit 3 sequentially supplies a gate pulse to the 480 gate lines. More particularly, when the data are written into a first pixel line along the gate line G1, the image data for the 640 pixels of the first pixel line stored in the data line drive circuit 2 are supplied to the data lines, and the gate line drive circuit 3 supplies the gate pulse to the gate line G1. The gate pulse turns on a thin film transistor of each pixel of the first pixel line, so that the image data are stored in a capacitor of each pixel formed by a pixel electrode, a liquid crystal layer and a common electrode, as well known in the art. When the data are written into a second pixel line along the gate line G2, the image data for the 640 pixels of the second pixel line stored in the data line drive circuit 2 are supplied to the data lines, and the gate line drive circuit 3 supplies the gate pulse to the gate line G2, and so on.

The FIG. 1(B) shows a timing diagram for sequentially supplying of the gate pulses to the 480 gate lines. During one frame period, the gate pulses are sequentially supplied to the 480 gate lines, so that the image data are sequentially written into the pixel lines during one frame period, as shown in the FIG. 1(B). A blanking period is provided between the adjacent two frame periods. The gate pulse has a width represented by a time period TA, which is represented by (the length of the frame period)/(the number of the gate lines). The time period TA is designed to turn on the thin film transistor of each pixel for sufficiently writing the image data into the capacitance of each pixel.

A problem in this scheme is that when the displayed image is changed for each frame period to display the motion picture, the displayed image of the one frame period remains in the human eyes as an afterimage and this afterimage overlaps with the display image of the next frame period, so that the image quality of the displayed image is degraded. FIG. 2 shows a timing diagram of a prior scheme for solving the problem of the afterimage caused in the scheme shown in the FIG. 1. One frame period is divided into a ½ frame period A and a ½ frame period B. During the first ½ frame period A, the 480 gate lines are sequentially activated to write the image data into all the pixel lines of the LCD array, and during the second ½ frame period B, the 480 gate lines are sequentially activated to write the black data into all the pixel lines of the LCD array. This operation can be performed by modifying the control scheme of the LCD device shown in the FIG. 1(A). Describing the write operation in the second ½ frame period B, when the black data are written into the first pixel line along the gate line G1, the black data for the 640 pixels of the first pixel line are stored in the data line drive circuit 2, and the gate line drive circuit 3 supplies the gate pulse to the gate line G1. The gate pulse turns on a thin film transistor of each pixel of the first pixel line, so that the black data are stored in the capacitance of each pixel. When the black data are written into the second pixel line along the gate line G2, the black data for the 640 pixels of the second pixel line are stored in the data line drive circuit 2, and the gate line drive circuit 3 supplies the gate pulse to the gate line G2, and so on. In this manner, the human eyes recognize the black image during the second ½ period B, and the afterimage of the image displayed in the first ½ period A is deleted from the human eyes during the ½ frame period B and is not overlap with the image of the next frame period. Although this scheme solves the problem of the afterimage, this scheme causes a new problem that the width of the gate pulse is reduced into TA/2, since the number of gate pulses twice as much as that of the FIG. 1(B) is required during one frame period, so that image data is not sufficiently written into the capacitance of the pixel, whereby the sufficient control of gray scale is not performed.

FIG. 3 shows a prior LCD device for solving the problem in the scheme shown in the FIG. 2. The LCD array is divided into a LCD array A which includes the gate lines G1 through G240 and a LCD array B which includes the gate lines G241 through G480, and the data line drive circuit 4 is used to supply the data to the LCD array A and the data line drive circuit 5 is used to supply the data to the LCD array B. The FIG. 3(B) shows a timing diagram of the operation of the LCD device. One frame period is divided into a ½ frame period A and a ½ frame period B. During the ½ frame period A of the first frame period, the 240 gate lines of the LCD array A are sequentially activated to write the image data into all the pixel lines of the LCD array A. During the ½ frame period B of the first frame period, the 240 gate lines of the LCD array A are sequentially activated to write the black data into all the pixel lines of the LCD array A, and the 240 gate lines of the LCD array B are sequentially activated to write the image data into all the pixel lines of the LCD array B. The black data for the LCD array B, into which the image data are written during the first frame period, are written in the ½ frame period A of the next frame period.

Since the LCD array is divided into the two halves, the write operation of the image data and the black data into the upper half A and the lower half B can be independently performed from each other, the width of the gate pulse can be maintained to the TA for sufficiently write the image data or the black data into the capacitance of each pixel, whereby this scheme solves the problem in the scheme shown in the FIG. 2. However, this scheme causes a new problem that this scheme requires the division of the LCD array into the two halves and the two data line drive circuits 4 and 5, so that the complicated control for supplying the data into the data line drive circuits 4 and 5 is required and the fabrication cost is increased.

SUMMARY OF THE INVENTION

Accordingly, it is an object of the present invention to provide the display apparatus which can prevent the display image from becoming unclear due to an overlap of the afterimage of the display image of the preceding frame period with the display image of the current frame period to improve the image quality of the motion picture, without requiring the division of the LCD array into the two halves and the two data line drive circuits.

In a first aspect of the present invention, a display apparatus in accordance with the present invention includes:

a display surface having a plurality of pixel lines; and a write circuit adapted to sequentially write an image into each of said plurality of pixel lines, wherein said write circuit writes, during a time period for writing said image into at least one pixel line, a black color into another pixel line.

The another pixel line may be separated from the at least one pixel line by a predetermined distance.

The write circuit may write the black color into a plurality of pixel lines separated from the at least one gate line by the predetermined distance.

In a second aspect of the present invention, a display apparatus includes:

a display surface having a plurality of data lines arranged along one direction and a plurality of gate lines arranged along the other direction crossing the one direction, wherein one picture element is formed at each one of cross points of the data lines and the gate lines;

a data line drive circuit adapted to supply a data signal, which includes a black color signal portion and an image signal portion, to each of the plurality of data lines; and a gate line drive circuit adapted to sequentially supply a gate pulse to each of the plurality of gate lines.

The gate line drive circuit supplies, during a write period for writing the data signal, a wide gate pulse, which gates both the black color signal portion and image signal portion of the data signal, to at least one gate line, and a narrow gate pulse, which gates the black color signal portion of the data signal, to another gate line.

The another gate line may be separated from the at least one gate line by a predetermined distance.

The black color signal portion may be included in a front portion of the data signal.

Preferably, the gate line drive circuit supplies the narrow gate pulse to a plurality of gate lines which are separated from the at least one gate line by the predetermined distance.

In a third aspect of the present invention a display apparatus includes:

a display surface having a plurality of data lines arranged in one direction and a plurality of gate lines arranged in the other direction crossing the one direction, wherein one picture element is formed at each of cross points of the data lines and the gate lines;

a data line drive circuit adapted to supply a data signal, which includes a black color signal portion and an image signal portion, to each of the plurality of data lines; and a gate line drive circuit adapted to sequentially supply a gate pulse to each of the plurality of gate lines.

The gate line drive circuit supplies, during a write period for writing the data signal, a first gate pulse, which gates the image signal portion of the data signal, to at least one gate line, and a second gate pulse, which gates the black color signal portion of the data signal, to another gate line.

The image signal portion may be included in a front portion of the data signal.

In a fourth aspect of the present invention, a display apparatus in accordance with the present invention includes:

a display surface having a plurality of data lines arranged in one direction and Y gate lines arranged in the other direction crossing the one direction, wherein the Y is an integer equal to or larger than 1, one pixel is formed at each of cross points of the data lines and the gate lines, and a plurality of pixels along each of the Y gate lines form one pixel line;

a data line drive circuit for supplying a data signal, which includes a black color signal portion and an image signal portion, to each of the plurality of data lines; and a gate line drive circuit for sequentially supplying a gate pulse to each of the Y gate lines.

The gate line drive circuit supplies, during a write period for writing the data signal, a wide gate pulse, which gates both the black color signal portion and image signal portion of the data signal, to at least one gate line, and a narrow gate pulse, which gates the black color signal portion of the data signal, to another gate line separated from the at least one gate line. The gate line drive circuit sequentially supplies the wide gate pulse to each of the Y gate lines during a frame period including a time periods $T_1$ through $T_N$, wherein the N is 1 through Y. One frame period and next frame period are separated by a blanking period. The black color signal portion is written, during the blanking period, into at least one pixel line which succeeds to the pixel line into which the black color is written during the last time period $T_N$ in the one frame.

Preferably, a polarity of the data signal supplied to each pixel line is alternately inverted in successive frame periods. The blanking period includes even time periods $T_{B1}$ through $T_{BE}$, each of which has a length equal to each of the time periods $T_1$ through $T_N$. The polarity of the data signal is adjusted, during the blanking period, to provide the data signal with a polarity which is opposite to that of the data signal supplied in a preceding frame period.

Still preferably, a polarity of the data signal supplied to each pixel line is alternately inverted in successive frame periods. The blanking period includes odd time periods $T_{B1}$ through $T_{BO}$ each of which has a length equal to each of the time periods $T_1$ through $T_N$. The black color signal portion is written, during the blanking period, into the pixel lines equal to the number of the odd time periods $T_{B1}$ through $T_{BO}$ during the blanking period.

The present invention realizes the display apparatus which can prevent the display image from becoming unclear due to an overlap of the afterimage of the display image of the preceding frame period with the display image of the current frame period to improve the image quality of the motion picture, without requiring the division of the LCD array into the two halves and the two data line drive circuits.

BRIEF DESCRIPTION OF THE DRAWINGS

FIG. 1 shows a schematic configuration of a prior LCD device and a timing diagram of the sequential supply of the gate pulses to the gate lines.

FIG. 3 shows a prior LCD device for solving the problem in the scheme shown in the FIG. 2.

DETAILED DESCRIPTION OF PREFERRED EMBODIMENTS OF THE INVENTION

Figure 2:
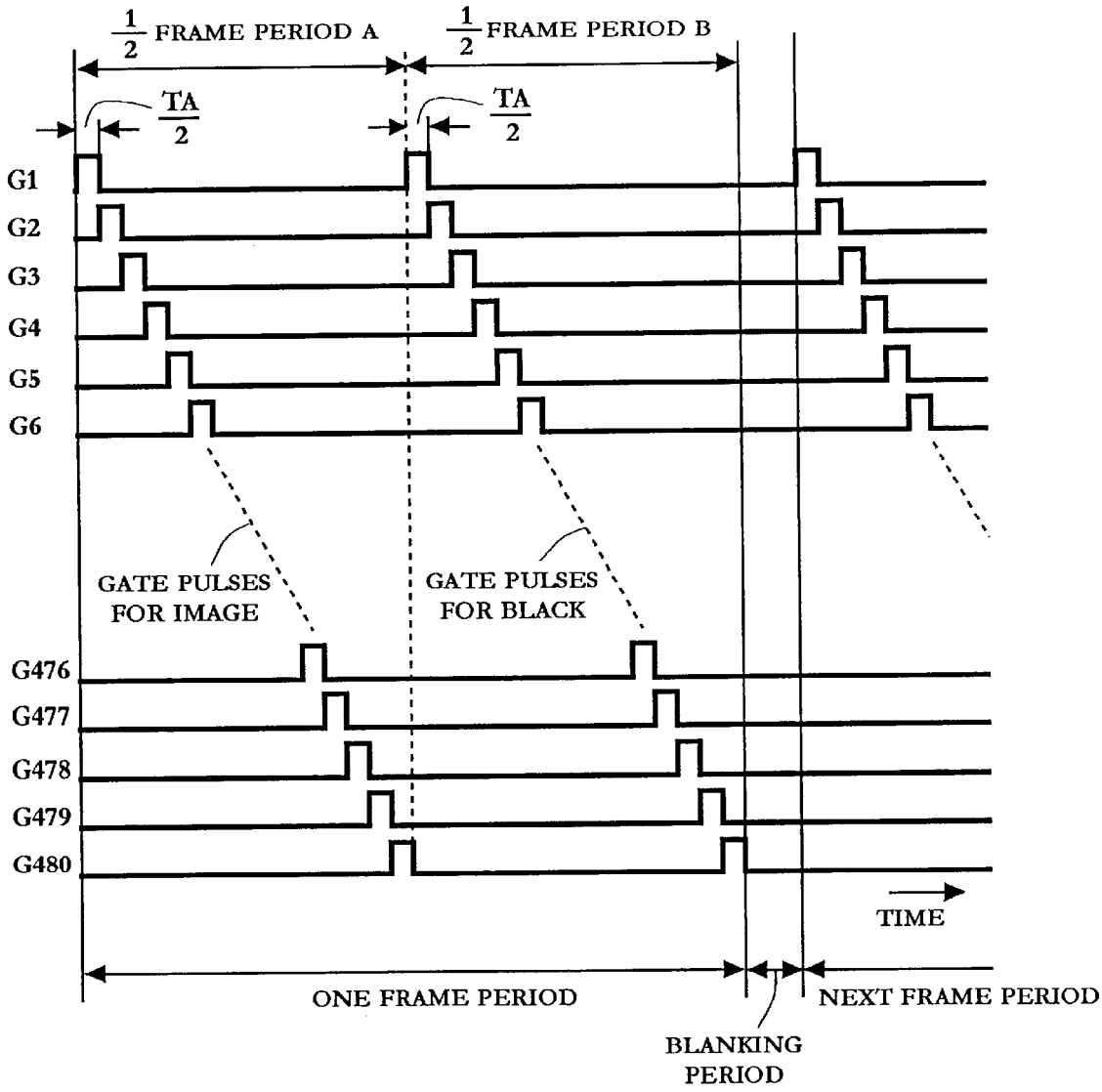
FIG. 2 shows a timing diagram of a prior scheme for solving the problem of the afterimage.

FIG. 4(A) shows the LCD device 7 in accordance with the present invention. The LCD device 7 includes a LCD array or a display surface 8, a data line drive circuit 9, a gate line drive circuit 10 and a clock generating circuit 11. For example, the LCD array 8 has 640×480 pixels of the VGA scheme wherein 640 pixels are arranged in a horizontal direction along the gate line, and the 480 pixels are arranged in a vertical direction. If it is required to display a color image, the number of pixels is increased to (640×3)×480 in which three cells, i.e. a Red cell, a Green cell and a Blue cell are required for one pixel. Another LCD array having 800×600 pixels of SVGA (Super Video Graphic Array) scheme or 1024×768 pixels of XGA (Extended Graphic Array) scheme, etc. can be used. However, the present invention is described by using a LCD array or a display surface having only 24 pixels in the horizontal direction and 20 pixels in the vertical direction for simplifying the description and the drawings.

At each cross point of the data lines and the gate lines, one pixel is connected to store the charges representing the image to be displayed. FIG. 4(B) shows a circuit of one pixel in which a source electrode of a thin film transistor (TFT) 12 is connected to the data line, a gate electrode of the TFT 12 is connected to the gate line, and a drain electrode of the TFT 12 is connected to a pixel electrode 13 formed on one glass substrate. The pixel electrode 13 formed on one glass substrate and a common electrode 15 formed on the other glass substrate, and a liquid crystal layer 14 sandwiched between the pixel electrode 13 and the common electrode 15 forms the capacitor for storing the charges representing the image to be displayed. When the image data is written into the pixel, the gate pulse applied to the gate line turns the TFT 12 on, so that the voltage representing the image data applied on the data line is applied to the capacitor through the TFT 12 to charge the capacitor to a level representing the image.

Figure 5:
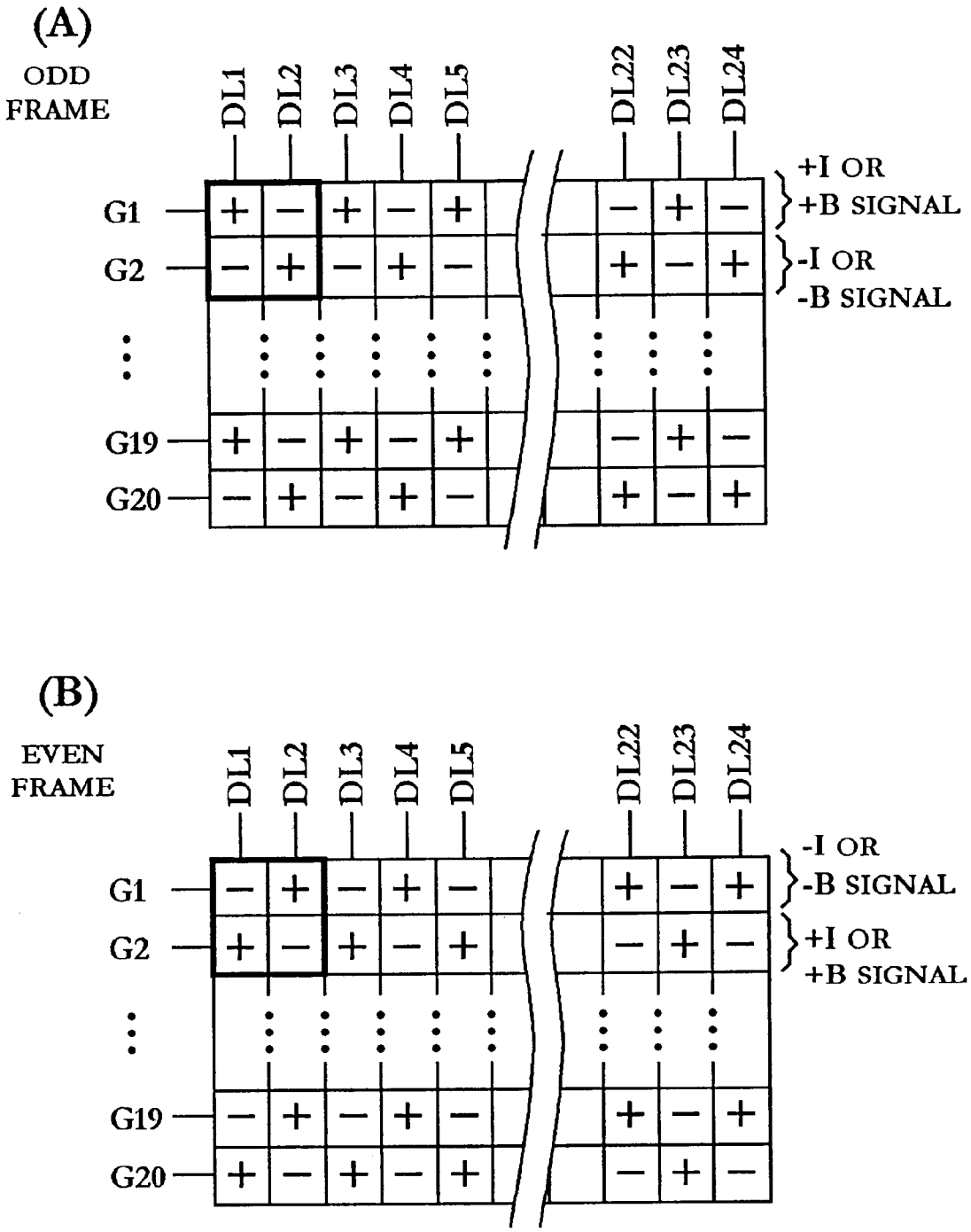
FIG. 5 shows the polarity of data signals applied during odd frame period and even frame periods.
Figure 6:
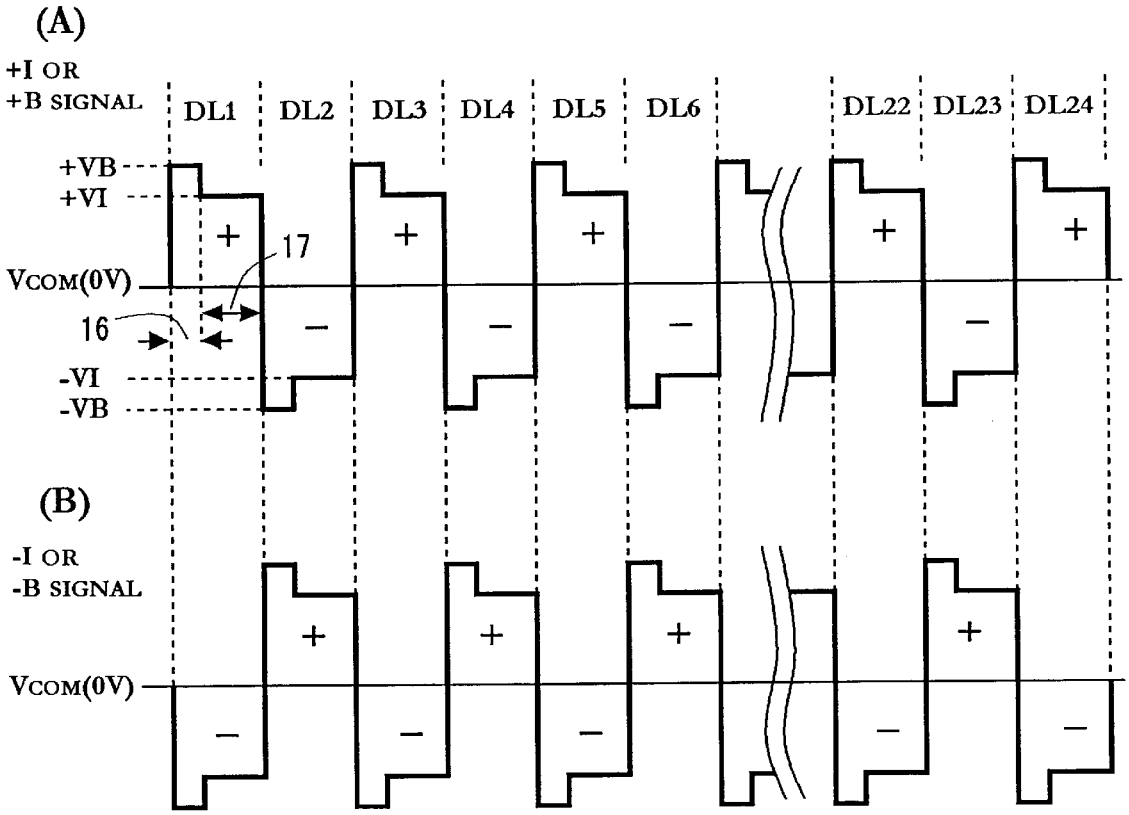
FIG. 6 shows the data signals applied to the pixel lines.

If the liquid crystal material is continuously applied with a DC voltage, the liquid crystal material is damaged. To prevent the damage to the liquid crystal material, the polarity of the data signal applied to the liquid crystal material is periodically inverted, as well known in the art. In the embodiment of the present invention, the so-called H/V inversion (Horizontal/Vertical inversion) is used. Describing the H/V inversion with reference to FIGS. 5 and 6, the FIG. 5(A) shows the polarity of data signals applied to the 24×20 pixels with respect to the common electrode during odd frame periods, and the FIG. 5(B) shows the polarity of data signals applied to the 24×20 pixels with respect to the common electrode during even frame periods. The FIG. 6(A) shows the data signals of the odd pixel lines along the gate lines in the FIG. 5(A) and the data signals of the even pixel lines in the FIG. 5(B). The FIG. 6(B) shows the data signals of the even pixel lines in the FIG. 5(A) and the data signals of the odd pixel lines in the FIG. 5(B). The polarities of the data signals are alternately changed with respect to the voltage VCOM (0V, in this case), which is the voltage applied to the common electrode 15. Paying attention to the four pixels at the cross points of the data lines DL1 and DL2 and the gate lines G1 and G2, as one example, the polarities of the adjacent pixels in the horizontal direction are opposite to each other, and the polarities of the adjacent pixels in the vertical direction are opposite to each other. Also, the polarities of the four pixels in the odd frame period and the polarities of the four pixels in the even frame period are opposite to each other. In this manner, the polarity of one pixel is changed in each of the odd or even frame periods, and the polarities of the adjacent pixels are opposite to each other.

It is noted in the present invention that data signal for one pixel includes (a) a first portion or black signal portion 16 for defining the full black to the voltage level +VB or −VB for deleting or erasing the afterimage, and (b) a second portion or image signal portion 17 for defining the image to be displayed to the user, such as the motion picture, as shown in the FIG. 6(A), and the voltage level +VI, −VI of the image signal portion 17 is varied from the voltage level 0V to the voltage level +VB or −VB depending upon the brightness of the image of the pixel. The image signal of +VB or −VB indicates that the image itself is the full black color. For simplifying the drawings, the image signal portion 17 having the voltage level +VI or −VI is shown.

In the subject specification, the data signal of one pixel line which has the positive polarity signal at the first pixel position connected to the data line DL1 is called as "+I or +B signal", and the data signal of one pixel line which has the negative polarity signal at the first pixel position is called as "−I or −B signal", as shown in the FIGS. 5 and 6. Accordingly, the +I or +B signal is written into the odd pixel lines during the odd frame periods and into the even pixel lines during the even frame periods, and the −I or −B signal is written into the even pixel lines during the odd frame periods and into the odd pixel lines during the even frame periods, as shown in the FIGS. 5(A) and (B).

Figure 7:
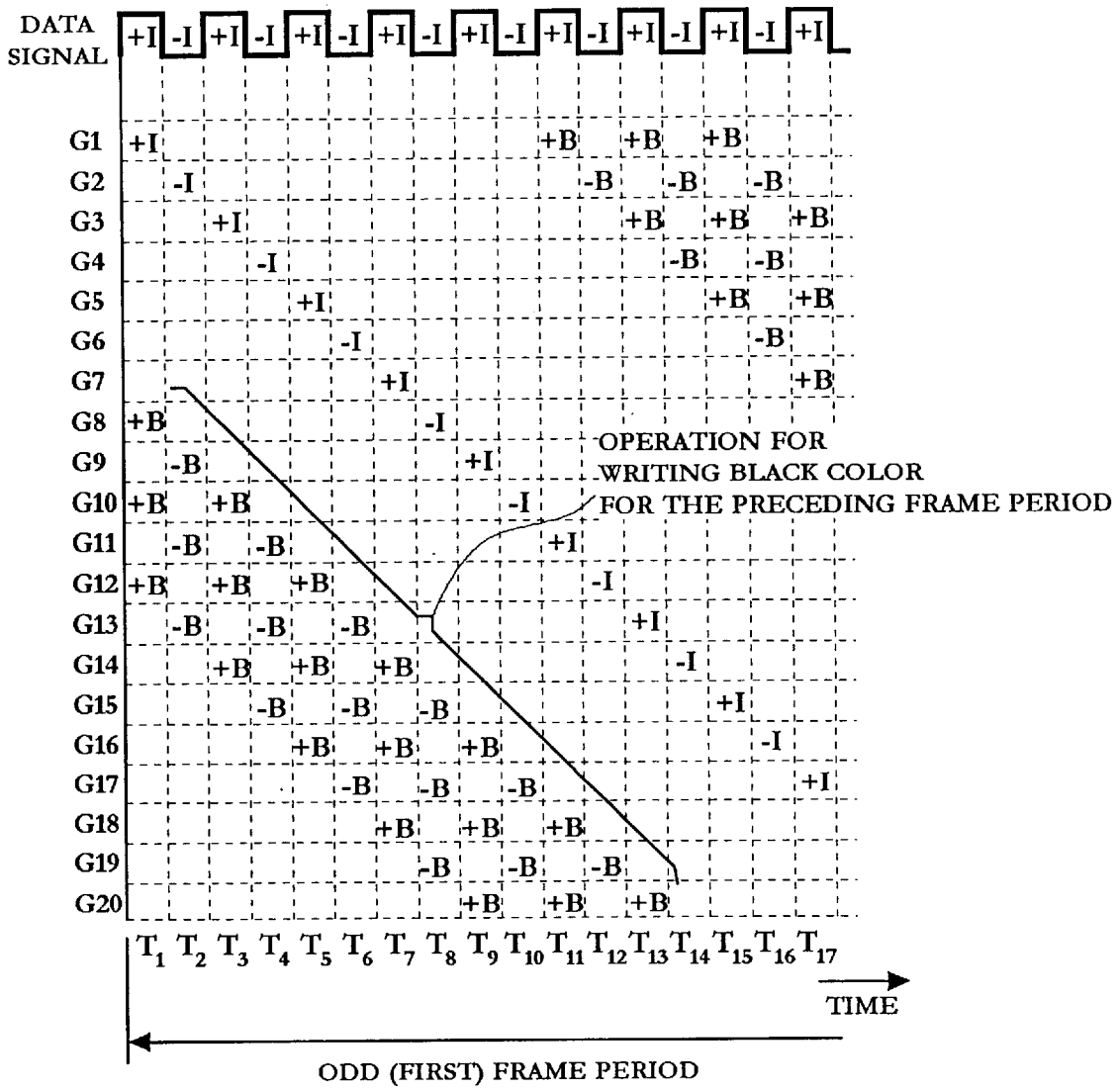
FIG. 7 shows a first embodiment of a timing diagram for writing the image and the black color or the full black image for deleting the afterimage into the LCD array.
Figure 8:
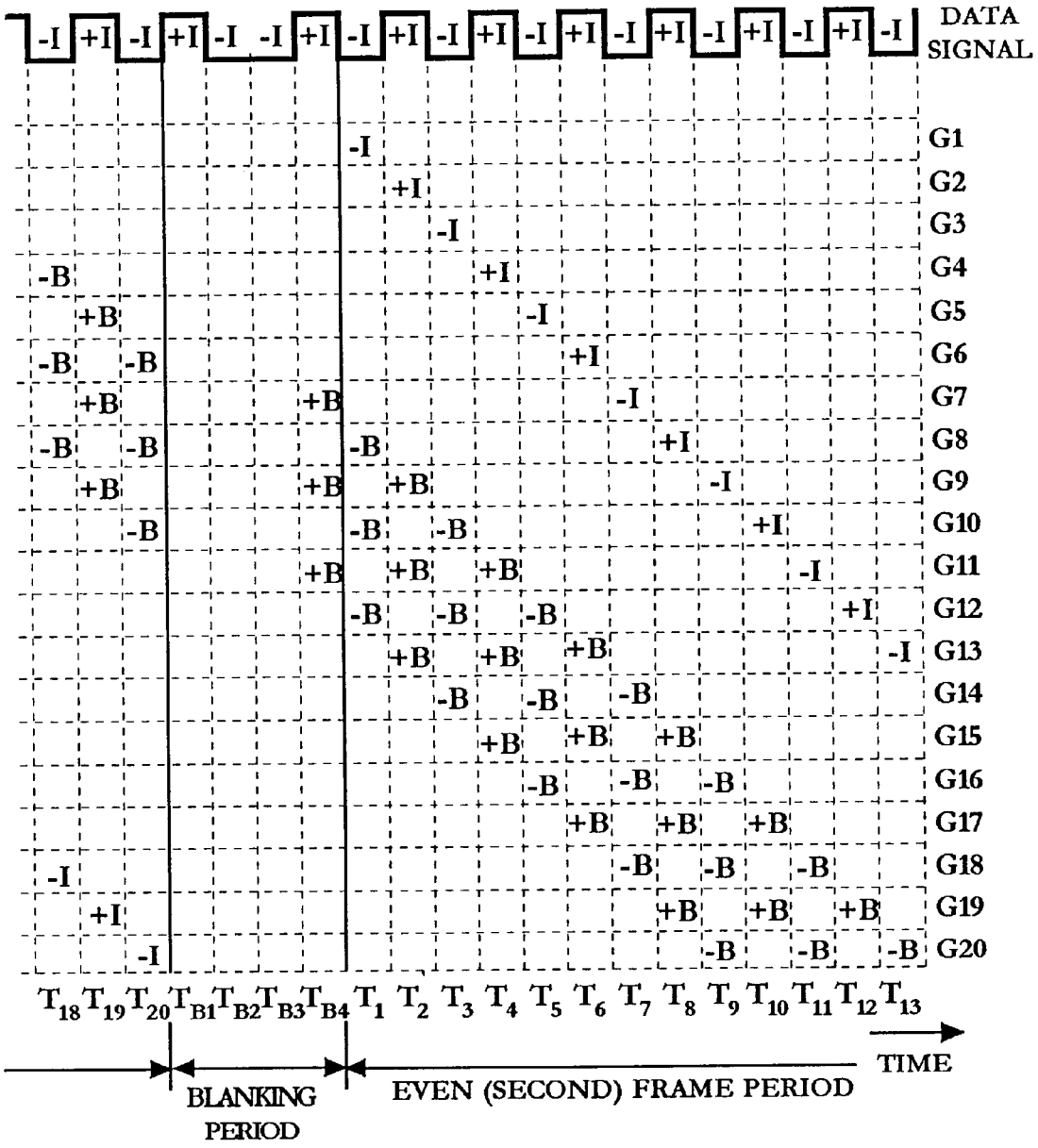
FIG. 8 shows the timing diagram continued to the timing diagram shown in the FIG. 7.
Figure 9:
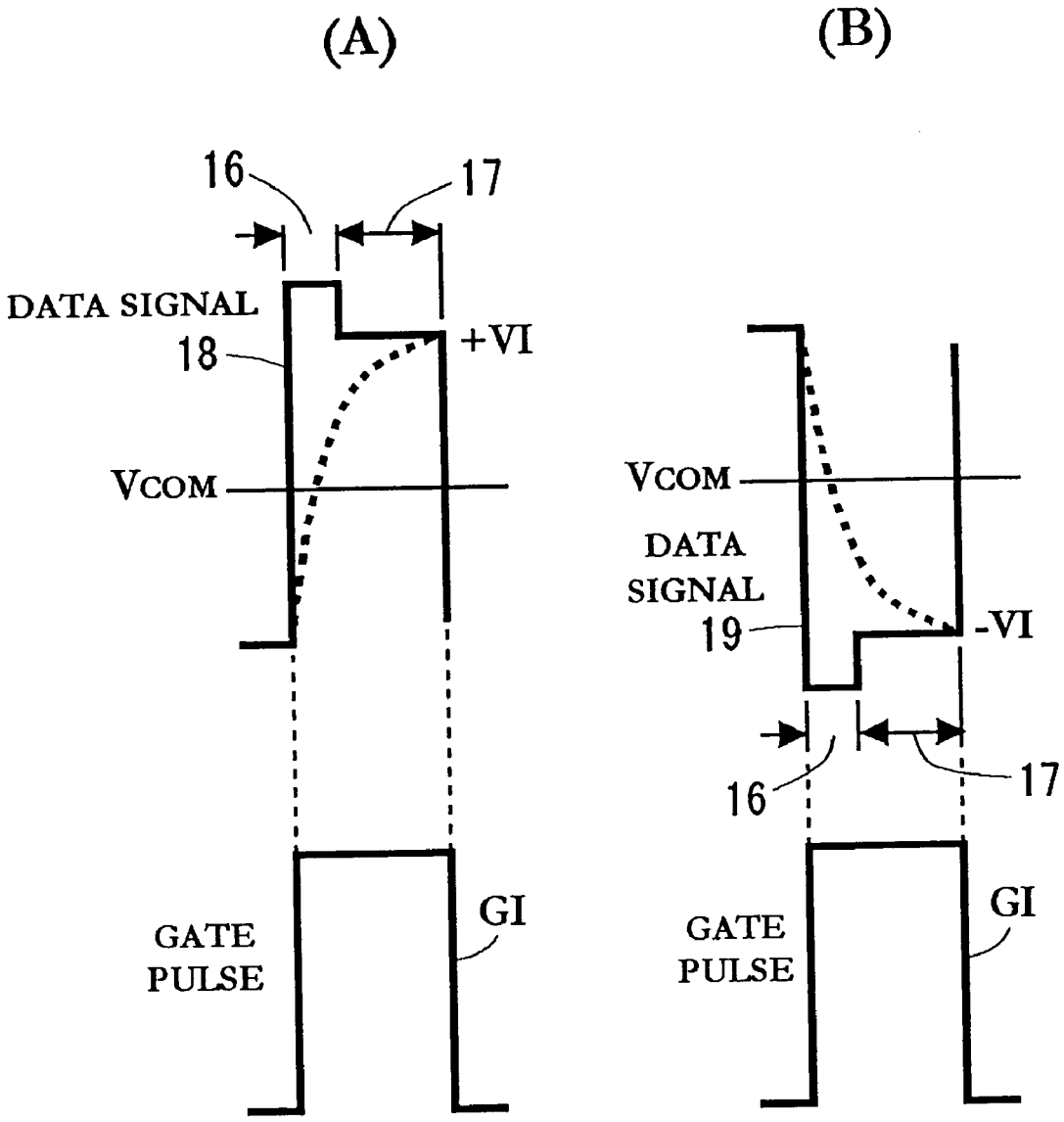
FIG. 9 shows the data signal and the gate pulse for writing the image into the LCD array.
Figure 10:
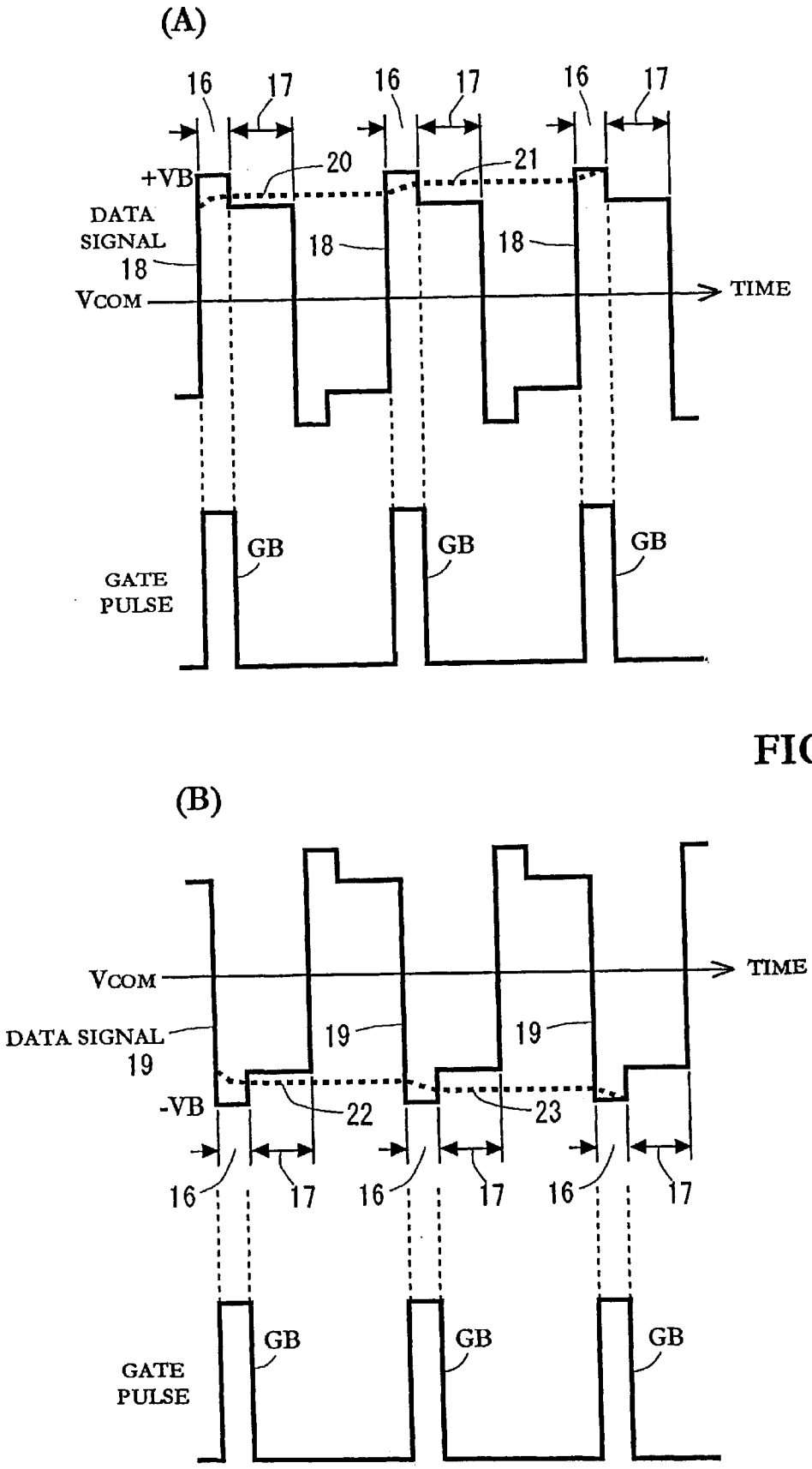
FIG. 10 shows the data signal and the gate pulse for writing the full black image into the LCD array.

The operation of the present invention is described with reference to FIGS. 7, 8, 9 and 10. The FIGS. 7 and 8 show a first embodiment of a timing diagram for writing the image and the full black color for deleting the afterimage into the LCD array. The FIG. 9 shows the gate pulse for writing the image into the LCD array. The FIG. 10 shows the gate pulse for writing the full black color into one pixel, and shows that the black color is written into each pixel three times as a lapse of time. It is noted that the present invention is described by using the LCD array having only 24 pixels in the horizontal direction and 20 pixels in the vertical direction for simplifying the description and the drawings, as stated before, and hence, the number Y of pixel lines or gate lines is 20 in this case.

The write operation for an odd frame period and an even frame period is shown in the FIGS. 7 and 8. A blanking period having even time period periods $T_{B1}$ through $T_{BE}$, such as four time periods $T_{B1}$ through $T_{B4}$, is inserted between the odd frame period and the even frame period. One frame period F for displaying the image on the display surface of the display device includes a plurality of image write periods $T_1$ through $T_Y$, in this case, $T_1$ through $T_{20}$. The image write period is called as a time period hereinafter. It is assumed that the capacitors of all the pixels of the LCD array are cleared or reset, and the odd and even frame periods shown in the FIGS. 7 and 8 are a first frame period and a second frame period, respectively, and in this case, the operation for writing the black color for the preceding frame period shown in the FIG. 7 is not performed. This operation is described later.

Briefly describing the concept of the present invention, the image to be displayed to the user (called as the image) is initially written into all the pixels of one pixel line by gating both the black signal portion 16 and image signal portion 17 of the data signal during one time period in one frame period, as shown in the FIG. 9, and before that the image is rewritten into this one pixel line during the next frame period, the black color for deleting the afterimage is written into all the pixels of this one pixel line by gating only the black signal portion 16, as shown in the FIG. 10.

To this end, the two kinds of gate pulses GI and GB are used in the present invention. The gate pulse GI is shown in the FIG. 9, and has a wide pulse width to gate both the black signal portion 16 and image signal portion 17 of the data signal. In the FIG. 9(A), both the black signal portion 16 and image signal portion 17 of the positive data signal 18 are written into the capacitor of one pixel, whereby the potential in the capacitor of the pixel is varied as shown by a dashed line. In the FIG. 9(B), both the black signal portion 16 and image signal portion 17 of the negative data signal 19 are written into the capacitor of one pixel, whereby the potential in the capacitor of the pixel is varied as shown by a dashed line. The gate pulse GB is shown in the FIG. 10, and has a narrower pulse width than that of the gate pulse GI to gate only the black signal portion 16 of the data signal. It is noted that the black signal portion 16 is disposed in a front portion of the data pulse 18 or 19 and is followed by the image signal portion 17 for the reason that the black signal portion 16 fixed to the full black voltage level +VB or −VB assists to quickly change the potential in the capacitor along the dashed line in the FIG. 9 during the write operation, so that the desired image voltage +VI or −VI can be written into the capacitor of the pixel even if the width of the data pulse of the high resolution display device becomes narrow. In the FIG. 10(A), three gate pulses GB are used to supply the black signal portions 16 of the successive three positive data signals 18 to the capacitor of one pixel three times. The reasons for using the three gate pulses GB are that the capacitor of the pixel can not be charged to the full black voltage +VB within the time period of one gate pulse GB. If it is possible to design the characteristic of the TFT or the black signal portion 16 of the data signal to write the full black level into the capacitor within the time period of one gate pulse GB, only one gate pulse GB can be used. In the case of the high resolution display device, however, the time period of the gate pulses GI and GB becomes short in proportion to the increase of the resolution, so that it is difficult to charge the capacitor of the pixel to the full black level within the time period of one gate pulse GB. accordingly, it is preferable to write the full black level into the capacitor over plural times in the high resolution display device. The subject embodiment uses the three gate pulses GB. In this case, the potential in the capacitor of the pixels gradually increased to the +VB as shown by a dashed line. In the FIG. 10(B), the three gate pulses GB are used to supply the black signal portions 16 of the successive three negative data signals 19 to the capacitor of the pixel three times. In this case, the potential in the capacitor of the pixel is gradually increased to the −VB as shown by a dashed line.

Figure 4:
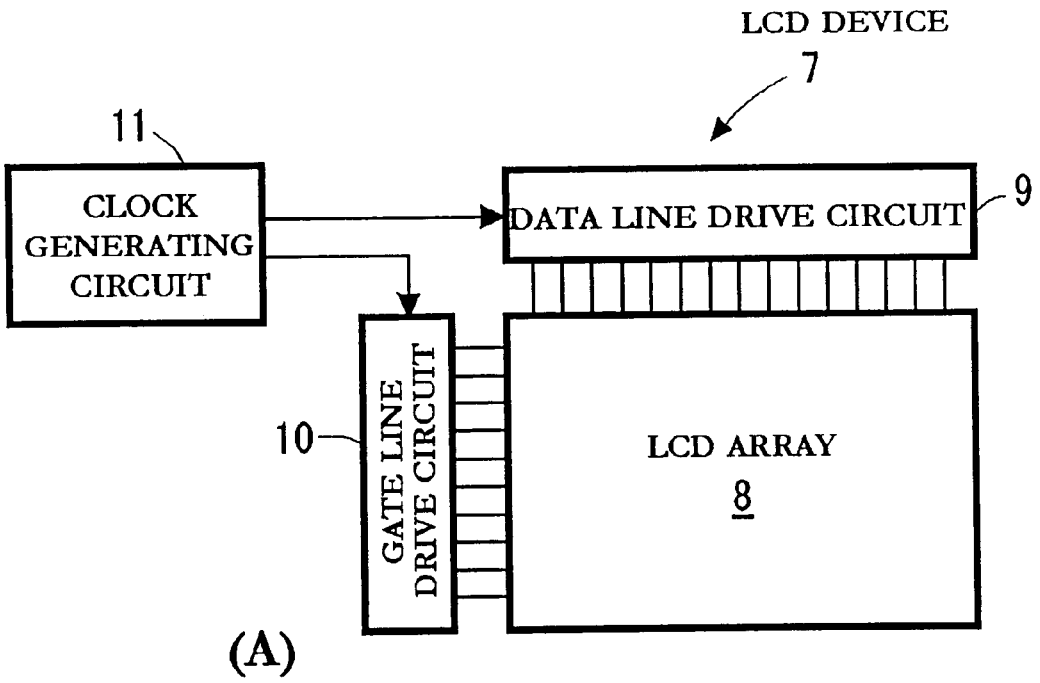
FIG. 4 shows the LCD device in accordance with the present invention.
Figure 4:
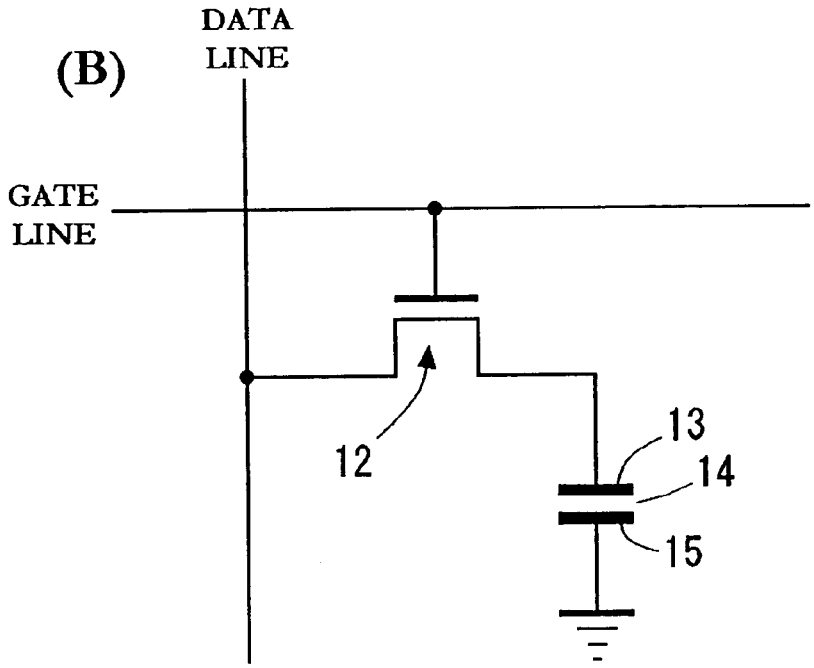

The data line drive circuit 9 and the gate line drive circuit 10 shown in the FIG. 4 supply the image signal, i.e. the combination of +I and +B or the combination of −I and −B, and the gate pulses, i.e. GI or GB, to the data lines and the gate lines, respectively at the time periods under the control of clock pulses, not shown, supplied from the clock pulse generating circuit, as described after.

Write Operation During the First Frame Period

Referring to the FIGS.7 and 8, again, the DATA SIGNAL +I corresponds to the +I or +B signal shown in the FIG. 6(A), and the DATA SIGNAL −I corresponds to the −I or −B signal shown in the FIG. 6(B). At the time period $T_1$ of the first frame period in the FIG. 7, the wide gate pulse GI is supplied to the gate line G1 to gate the data signal +I to the first pixel line of the LCD array, so that the image of the data signal +I is displayed.

At the time period $T_2$ of the first frame period, the wide gate pulse GI is supplied to the gate line G2 to gate the data signal −I to the second pixel line of the LCD array, so that the image of the data signal −I is displayed.

At the time period $T_3$ of the first frame period, the wide gate pulse GI is supplied to the gate line G3 to gate the data signal +I to the third pixel line of the LCD array, so that the image of the data signal +I is displayed, and so on. Such write operation is repeated until the tenth pixel line related to the gate line G10. At this point of time, only the image has been written into the ten pixel lines related to the gate lines G1 through G10.

At the time period $T_{11}$, the write operation for simultaneously writing both the image +I into the pixel line related to the gate line G11 by using the wide gate pulse GI and the black color +B into the pixel line related to the gate line G1 by using the narrow gate pulse GB is performed, so that the pixel line related to the gate line G11 displays the image +I, and the pixel line related to the gate line G11 displays the black color +B of the first black voltage level 20, as shown in the FIG. 10(A). It is apparent that the write operation of the image into the pixel line related to the gate line G1 is performed in the time period $T_1$, and the write operation of the black color into this pixel line is started at the time period $T_{11}$.

At the time period $T_{12}$, the write operation for simultaneously writing both the image −I into the pixel line related to the gate line G12 by using the wide gate pulse GI and the black color −B into the pixel line related to the gate line G2 by using the narrow gate pulse GB is performed, so that the pixel line related to the gate line G12 displays the image −I, and the pixel line related to the gate line G2 displays the black color −B of the first black voltage level 22, as shown in the FIG. 10(B).

At the time period $T_{13}$, the write operation for simultaneously writing all the image +I into the pixel line related to the gate line G13 by using the wide gate pulse GI, the black color +B into the pixel line related to the gate line G1 by using the narrow gate pulse GB and the black color +B into the pixel line related to the gate line G3 by using the narrow gate pulse GB is performed, so that the pixel line related to the gate line G13 displays the image +I, the pixel line related to the gate line G1 displays the black color +B of the second black voltage level 21, as shown in the FIG. 10(A) and the pixel line related to the gate line G3 displays the black color +B of the first black voltage level 20.

At the time period $T_{14}$, the write operation for simultaneously writing all the image −I into the pixel line related to the gate line G14 by using the wide gate pulse GI, the black color −B into the pixel line related to the gate line G2 by using the narrow gate pulse GB and the black color −B into the pixel line related to the gate line G4 by using the narrow gate pulse GB is performed, so that the pixel line related to the gate line G14 displays the image −I, the pixel line related to the gate line G2 displays the black color −B of the second black voltage level 23, as shown in the FIG. 10(B) and the pixel line related to the gate line G4 displays the black color −B of the first black voltage level 22.

At the time period $T_{15}$, the write operation for simultaneously writing all the image +I into the pixel line related to the gate line G15 by using the wide gate pulse GI, the black color +B into the pixel line related to the gate line G1 by using the narrow gate pulse GB, the black color +B into the pixel line related to the gate line G3 by using the narrow gate pulse GB, and the black color +B into the pixel line related to the gate line G5 by using the narrow gate pulse GB is performed, so that the pixel line related to the gate line G15 displays the image +I, the pixel line related to the gate line G1 displays the black color +B of the final black voltage level +VB, as shown in the FIG. 10(A), the pixel line related to the gate line G3 displays the black color +B of the second black voltage level 21 and the pixel line related to the gate line G5 displays the black color of the first black voltage level 20.

The contents displayed on the display surface of the LCD array as of this time period $T_{15}$ are, as follows.

The pixel line related to the G1:

The black color +B of the final black voltage level +VB

The pixel line related to the G2:

The black color −B of the second black voltage level 23

The pixel line related to the G3:

The black color +B of the second black voltage level 21

The pixel line related to the G4:

The black color −B of the first black voltage level 22

The pixel line related to the G5:

The black color +B of the first black voltage level 20

The pixel lines related to the even gate lines G6 through G14:

The image −I

The pixel lines related to the odd gate lines G7 through G15:

The image +I

It is apparent that the write means, or the circuits 9, 10 and 11, sequentially writes the image into each of the plurality of pixel lines, and the write means writes, during a time period for writing the image into one pixel line, a black color into another pixel line. For example, at the time period $T_{11}$, the data signal +I is used to write the image +I into the pixel line related to the gate line G11 to which the wide gate pulse GI is supplied, and is also used to write the black color +B into the pixel line related to the gate line G1 to which the narrow gate pulse GB is supplied, and at the time period $T_{13}$, for example, the data signal +I is used to write the image +I into the pixel line related to the gate line G13 to which the wide gate pulse GI is supplied, and is also used to write the black color +B into the pixel lines related to the gate lines G1 and G3 to which the narrow gate pulse GB is supplied, and at the time period $T_{15}$, for example, the data signal +I is used to write the image +I into the pixel line related to the gate line G15 to which the wide gate pulse is supplied, and is also used to write the black color +B into the pixel line related to the gate lines G1, G3 and G5 to which the narrow gate pulse GB is supplied.

In this manner, the two kinds of gate pulses GI and GB are selectively supplied to the selected gate lines to simultaneously write both the image and black color into the related pixel lines.

The same write operation is repeated during the time periods $T_{16}$ through $T_{20}$ of the first frame period, as shown in the FIGS. 7 and 8. At the end ($T_{20}$) of the first frame, the pixel lines related to the gate lines G1 through G6 display the respective black color of the final level, i.e. +VB or −VB, and the remaining pixel lines related to the gate lines G7 through G20 display the black color of the second or first level or the image, i.e. +I or −I. More particularly, the pixel lines related to the gate lines G7 and G8 display the respective black color of the second black voltage level, i.e. the level 21 or 23, the pixel lines related to the gate lines G9 and G10 display the respective black color of the first black voltage level, i.e. the level 20 or 22, and the remaining pixel lines related to the gate lines G11 through G20 display the respective image, i.e. the image +I or −I.

The write operation for charging the capacitors of the remaining pixel lines related to the gate limes G7 through G20 to the final black voltage level, i.e. +VB or −VB, is performed after the first frame period. The blanking period including the even time periods $T_{B1}$ through $T_{BE}$, such as the four time periods $T_{B1}$ through $T_{B4}$, is inserted between the first frame period and the second frame period in this embodiment, as shown in the FIG. 8. The length of each time period included in the blanking period is equal to the length of each time period included in the frame period.

Operation During the Blanking Period

During the blanking period including the even time periods $T_{B1}$ through $T_{B4}$, the two operations are performed in this embodiment. One operation is to adjust the polarity of the data signal to invert the polarity of the data signal supplied to the pixel in the second frame period and the data signal is supplied to the data line drive circuit 9. The reason for the inversion of the polarity is that if the liquid crystal material is continuously applied with the DC voltage, the liquid crystal material is damaged, as well known in the art. In this embodiment, the adjustment of the polarity of the data signal is performed in the time period $T_{B3}$ wherein the polarity of the data signal is maintained at the negative polarity in the time period $T_{B3}$, as shown in the FIG. 8, so that the polarity of the data signal supplied to the pixel lines in the second frame is inverted in comparison to the polarity of the data signal supplied in the first frame period. The adjustment of the polarity of the data signal can be performed another time period, such as $T_{B2}$ or $T_{B4}$ in the blanking period.

The other operation is to write, during one time periods among the time periods $T_{B1}$ through $T_{B4}$ of the blanking period, the black color having the opposite polarity (+B) to the polarity of the black color (−B) written in the last time period $T_{20}$ of the first frame period, into the pixel lines G7, G9 and G11 which succeed to the pixel lines G6, G8 and G10 of the first frame period, respectively. In this manner, the black color signal portion is written into at least one pixel line which succeed to the pixel line into which the black color is written during the last time period $T_N$ or $T_{20}$ in the odd frame period. The reason for writing the black color +B in one time period of the blanking period is that the polarity of the data signal, i.e. the −I signal, supplied in the first time period $T_1$ in the second frame period is the same as that of the data signal (−I) supplied to the last pixel line relating to the gate line G20 in the first frame period, and hence it is impossible to supply the black signal +B to the capacitors of the pixels in the pixel lines related to the gate lines G7, G9 and G11 to rewrite the black color +B into them, until the second time period $T_2$ in the second frame period. One of the time periods $T_{B1}$ and $T_{B4}$ can be selected to rewrite the black color in the case that the blanking period includes four time periods. In the exemplary embodiment, the time period $T_{B4}$ is used to supply the black signal portion 16 of the data signal +I to the pixel line related to the gate lines G7, G9 and G11 by supplying the narrow gate pulses GB to these gate lines.

Write Operation During the Second Frame Period

The similar write operation to that performed in the first frame period is repeated in the second frame period except that the polarity of the data signal supplied to each of the pixel lines is inverted in the second frame period, as stated before. At the time period $T_1$ of the second frame period in the FIG. 8, the wide gate pulse GI is supplied to the gate line G1 to gate the data signal −I to the first pixel line of the LCD array to display the image −I, and the narrow gate pulses GB are supplied to the gate lines G8, G10 and G12 to gate the black color −B to the pixel lines related to these gate lines to write the black color −B.

In the same manner, the write operation of the image and the black color is repeated until the time period $T_{10}$ of the second frame period.

At the time period $T_{11}$, the write operation for simultaneously writing both the image −I into the pixel line related to the gate line G11 by using the wide gate pulse GI and the black color −B into the pixel lines related to the gate lines G1, G18 and G20 by using the narrow gate pulse GB is performed, so that the pixel line related to the gate line G11 displays the image −I, and the pixel line related to the gate lines G1 displays the black color −B of the first black voltage level 22, as shown in the FIG. 10(B), the pixel line related to the gate lines G18 displays the black color −B of the final black voltage level −VB, and the pixel line related to the gate lines G20 displays the black color −B of the second black voltage level 23.

At the time period $T_{13}$ in the second frame period, the write operation of the black color of the final black voltage level, i.e. the +VB or the −VB, into all the pixel lines of the LCD array is completed, whereby the image displayed in all the pixel lines in the first frame period is completely erased.

Describing the operation for writing the black color for the preceding frame period shown in the FIG. 7, this write operation is performed to erase the image displayed in all the pixel lines in the preceding frame period in the case that the frame period shown in the FIG. 7 is the odd frame period, such as a third, fifth or seventh frame period, except the first frame period.

The gate lines supplied with one wide gate pulse GI and a plurality of narrow gate pulses GB at a selected time period $T_{z,900}$ of the odd and even frame periods separated by the blanking period having the even time periods $T_{B1}$ through $T_{B4}$ in the timing chart shown in the FIGS.7 and 8 of the exemplary embodiment using the 20 gate lines are defined by the following equations.

| Time period $T_N$ | Gate line | Gate pulse |
|---|---|---|
| (Case A): $1 \leqq N \leqq 9$ | N | GI |
| | □□N + 7 | □□GB |
| | □□N + 9□□ | □□□□GB |
| | □□□□N + 11 | □□GB |

The case A relates to the case of N=1 through N=9, and relates to the time periods $T_1$ through $T_9$. In the time period $T_1$, for example, of the odd frame period, such as the third frame period, the gate lines G1 is supplied with the wide gate pulse GI, and the gate lines GB, G10 and G12 are supplied with the narrow gate pulse GB.

| | | | |
|---|---|---|---|
| (Case B): N = 10 | N | :(G10) | GI |
| | N + 7 | :(G17) | GB |
| | N + 9 | :(G19) | GB |

The case B relates to the case of N=10, and relates to the time periods $T_{10}$□

| | | | |
|---|---|---|---|
| (Case C): N = 11 | N | :(G11) | GI |
| | N + 7 | :(G18) | GB |
| | N + 9 | :(G20) | GB |
| | N + 10 | :(G21 or G1) | GB |

The case C relates to the time periods $T_{11}$□

| | | | |
|---|---|---|---|
| (Case D): N = 12 | N | :(G12) | GI |
| | N + 7 | :(G19) | GB |
| | N + 10 | :(G22 or G2) | GB |

The case D relates to the time periods $T_{12}$□□

| | | | |
|---|---|---|---|
| (Case E): N = 13 | N | :(G13) | GI |
| | N + 7 | :(G20) | GB |
| | N + 8 | :(G21 or G1) | GB |
| | N + 10 | :(G23 or G3) | GB |

The case E relates to the time periods $T_{13}$□

| | | | |
|---|---|---|---|
| (Case F): N = 14 | N | :(G14) | GI |
| | N + 8 | :(G22 or G2) | GB |
| | N + 10 | :(G24 or G4) | GB |

The case F relates to the time periods $T_{14}$□□

| | | |
|---|---|---|
| (Case G): $15 \leqq N \leqq 20$ | N | GI |
| | N + 6 | GB |
| | N + 8 | GB |
| | N + 10 | GB |

The case G relates to the case of N=15 through 20, and relates to the time periods T15 through T20. In the time period $T_{15}$, for example, the gate lines G15 is supplied with the wide gate pulse GI, and the gate lines G1, G3 and G5 are supplied with the narrow gate pulse GB.

In this manner, during one time period $T_N$, one gate line is supplied with the wide gate pulse GI to gate both the black signal portion 16 and image signal portion 17, so that the image is written into one pixel line related to this gate line, and another selected gate lines are supplied with the narrow gate pulse GB to gate only the black signal portion 16, so that the black color is written into the pixel lines related to these gate lines.

Figure 11:
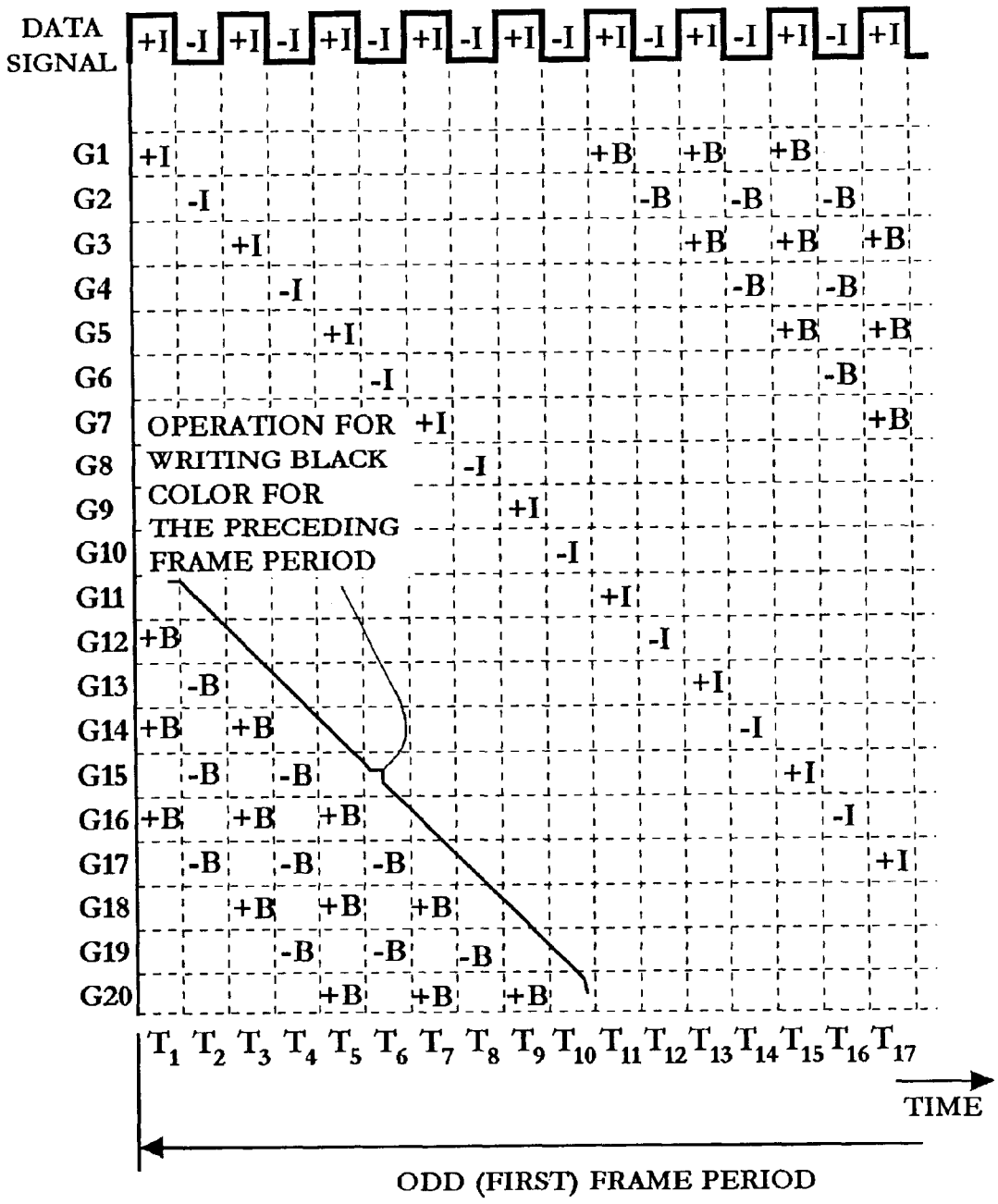
FIG. 11 shows a second embodiment of a timing diagram for writing the image and the full black color for deleting the afterimage into the LCD array.
Figure 12:
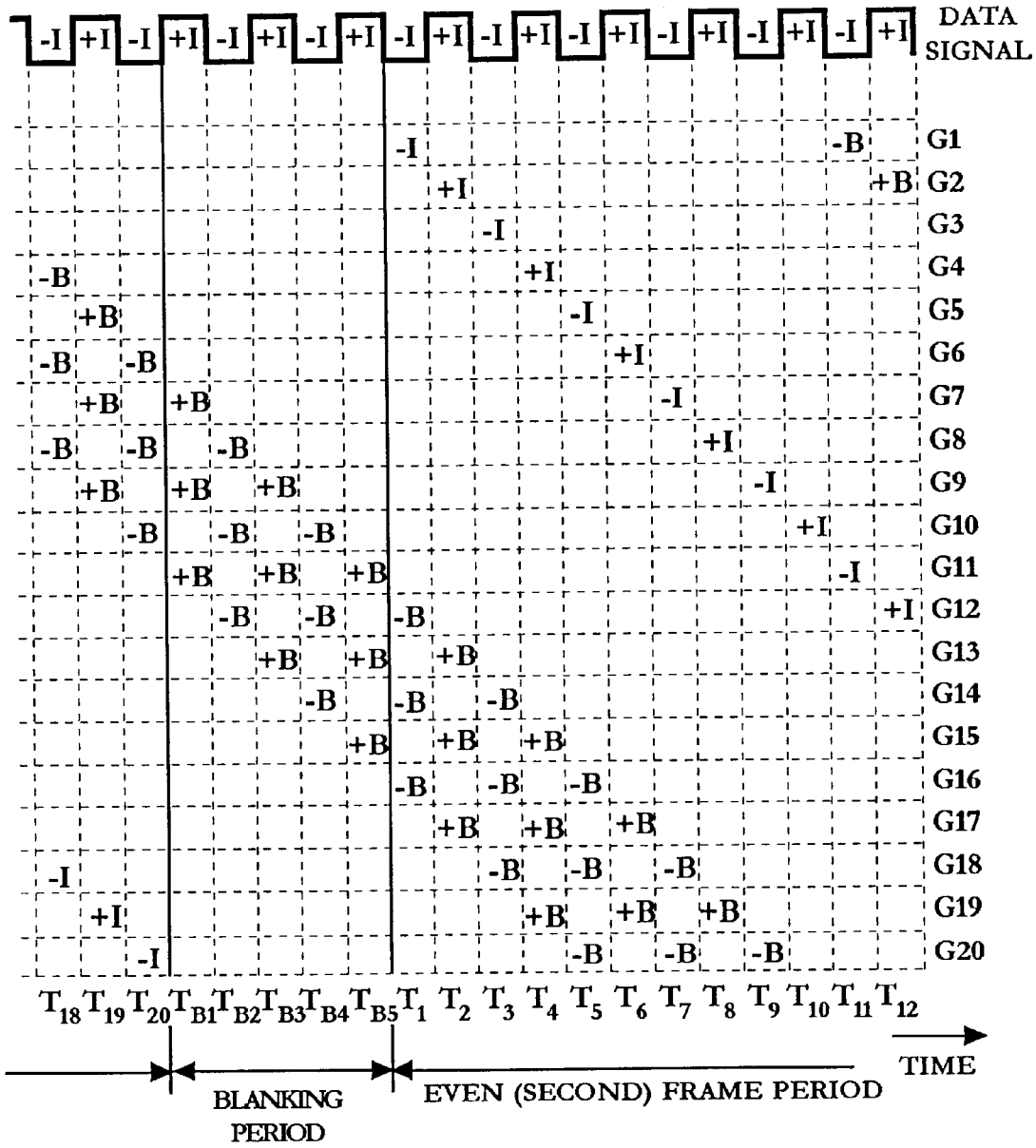
FIG. 12 shows the timing diagram continued to the timing diagram shown in the FIG. 11.

The FIGS.11 and 12 show a second embodiment of a timing diagram for writing the image and the full black color for deleting the afterimage into the LCD array. It is assumed that the capacitors of all the pixels of the LCD array are cleared or reset, and the odd and even frames shown in the FIGS.11 and 12 are a first frame and a second frame, respectively, and in this case, the operation for writing the black color for the preceding frame shown in the FIG. 11 is not performed. In the second embodiment, a blanking period including odd time periods $T_{B1}$ through $T_{BO}$, such as the five time periods $T_{B1}$ through $T_{B5}$, is inserted between the first frame period and the second frame period.

Write Operation During the First Frame Period

The timing of the write operation through the time periods $T_1$ through $T_{20}$ in the first frame period shown in the FIGS. 11 and 12 is the same as that shown in the FIGS.7 and 8.

Write Operation During the Blanking Period

During the blanking period including the odd time periods, such as the five time periods $T_{B1}$ through $T_{B5}$, the polarity of the data signals is alternately inverted and supplied to the data line drive circuit 9, and the black color is continuously supplied to the pixel lines related to the gate lines G7 through G15 by using the data signals +I, −I, +I, −I and +I, respectively. That is, the black color signal portion 16 is written into the pixel lines which succeed to the pixel lines, respectively, into which the black color is written during the last time period $T_N$ or $T_{20}$ in the odd frame period, and the black color signal portion 16 is written, during the blanking period, into the pixel lines equal to the sum of the number 4 and the number of the odd time periods $T_{B1}$ through $T_{BO}$ in the blanking period. More particularly, the black color +B of the black signal portion 16 shown in the FIG. 9(A) is supplied to the pixel lines related to the gate lines G7, G9 and G11 during the time period $T_{B1}$, the black color −B of the black signal portion 16 shown in the FIG. 9(B) is supplied to the pixel lines related to the gate lines G8, G10 and G12 during the time period $T_{B2}$, the black color +B is supplied to the pixel lines related to the gate lines G9, G11 and G13 during the time period $T_{B3}$, and so on. By using the blanking period having the odd time periods, the polarity of the data signal is inverted in each time period $T_{B1}$ through $T_{B5}$, whereby the data signal −I is supplied to the first pixel line in the first time period $T_1$ of the second frame period.

Write Operation During the Second Frame

The same write operation as that performed in the first frame period is repeated in the second frame except that the polarity of the data signal supplied to each of the pixel lines is inverted in the second frame period, as stated before. At the time period $T_1$ of the second frame period in the FIG. 12, the wide gate pulse GI is supplied to the gate line G1 to gate the data signal −I to the first pixel line of the LCD array to display the image −I, and the narrow gate pulses GB are supplied to the gate lines G12, G14 and G16 to gate the black color −B to the pixel lines related to these gate lines to write the black color −B.

The write operation of the image and the black color is repeated until the time period $T_{10}$ of the second frame period.

At the time period $T_{11}$, the write operation for simultaneously writing both the image −I into the pixel line related to the gate line G11 by using the wide gate pulse GI and the black color −B into the pixel lines related to the gate line G1 by using the narrow gate pulse GB is performed, so that the pixel line related to the gate line G11 displays the image −I, and the pixel line related to the gate lines G1 displays the black color −B of the first black voltage level 22, as shown in the FIG. 10(B). In this manner, the write operation of the image and the black color is continued in the second frame period. It is apparent that the time delay between the write operation of the image and the write operation of the black color of one pixel line is the F/2, wherein the F represents the length of one frame period.

By using the blanking period including the odd time periods, the black color is continuously written in the pixel lines related to the gate lines G1 through G20 over the first frame period, the blanking period and the second frame period, as shown in the FIGS. 11 and 12, whereby a length of a time period between the start time of the display of the image and the start time of the display of the black color for each pixel line is maintained at the constant value, i.e. the F/2 time period. It means that the time periods for displaying the image of all the pixel lines are equal to the F/2, so that a luminance of the image directed to the human eyes of the user, which is represented an integrated value of the incident light of the displayed image over the F/2 period, for all the pixel lines is maintained at a constant value.

Describing the operation for writing the black color for the preceding frame period shown in the FIG. 11, this write operation is performed to erase the image displayed in all the pixel lines in the preceding frame period in the case that the frame period shown in the FIG. 11 is the odd frame period, such as a third, fifth or seventh frame period, except the first frame period.

Since the black color is continuously written in the pixel lines during the blanking period in the second embodiment, the gate line related to the pixel line, into which the image is supplied, and the gate line(s) related to the pixel lines, into which the black color is supplied, at a selected time period $T_N$ of the odd or even frame period, are defined by the following equation. In the exemplary embodiment using the 20 gate lines, the number of gate lines Y=20, and the number N is 1 through Y (=20). The "n" represents the number of time periods included in the blanking period. In the exemplary embodiment, n=5. Further, the actual gate lines G1 through G20 are considered to be followed by five virtual gate lines G21 through G25, which are equal to the number "n". That is, the number of gate lines considered in this case is (Y+n), i.e. 25 gate lines. And, the virtual gate line G(Y+n+1), i.e. G26, is treated as the gate line G1 of the display surface of the LCD array.

| Gate line | Gate pulse |
|---|---|
| N | GI |
| N + (Y/2) + n − 4 | GB |
| N + (Y/2) + n − 2 | GB |
| N + (Y/2) + n | GB |

During the time period $T_1$ through $T_5$ of the odd frame period, such as the third frame period, the following gate lines are selected.

| Gate line | $T_1$ | $T_{2□□}$ | $T_{3□□}$ | $T_4$ | $T_{5□□}$ | Gate pulse |
|---|---|---|---|---|---|---|
| N | :G1 | G2 | G3 | G4 | G5 | GI |
| N + (Y/2) + n − 4 | :G12 | G13 | G14 | G15 | G16 | GB |
| N + (Y/2) + n − 2 | :G14 | G15 | G16 | G17 | G18 | GB |
| N + (Y/2) + n | :G16 | G17 | G18 | G19 | G20 | GB |

During the time period $T_6$ and $T_7$ of the odd frame period, the following gate lines are selected.

| Gate line | $T_6$ | $T_{7□□}$ | Gate pulse |
|---|---|---|---|
| N | :G6 | G7 | GI |
| N + (Y/2) + n − 4 | :G17 | G18 | GB |

-continued

| Gate line | $T_6$ | $T_7$ □□ | Gate pulse |
|---|---|---|---|
| N + (Y/2) + n − 2 | :G19 | G20 | GB |
| N + (Y/2) + n | :*G21 | *G22 | |

It is noted that the gate lines G21 and G22 selected in the time periods $T_6$ and $T_7$ are the virtual gate lines which are not actually provided in the LCD array, so that only the gate lines G6, G17 and G19 are selected in the time period $T_6$, and only the gate lines G7, G18 and G20 are selected in the time period $T_7$. The virtual or nonselected gate lines are represented by the symbol *.

During the time period $T_8$ and $T_9$ of the odd frame period, the following gate lines are selected.

| Gate line | $T_8$ | $T_9$ □□ | Gate pulse |
|---|---|---|---|
| N | :G8 | G9 | GI |
| N + (Y/2) + n − 4 | :G19 | G20 | GB |
| N + (Y/2) + n − 2 | :*G21 | *G22 | |
| N + (Y/2) + n | :*G23 | *G24 | |

Only the gate lines G8 and G19 are selected in the time period $T_8$, and only the gate lines G9 and G20 are selected in the time period $T_9$.

During the time period $T_{10}$ of the odd frame period, the following gate lines are selected.

| Gate line | $T_{10}$□□ □□ | Gate pulse |
|---|---|---|
| N | :G10 | GI |
| N + (Y/2) + n − 4 | :*G21 | |
| N + (Y/2) + n − 2 | :*G23 | |
| N + (Y/2) + n | :*G25 | |

Only the gate lines G10 is selected in the time period $T_{10}$.

During the time period $T_{11}$ and $T_{12}$ of the odd frame period, the following gate lines are selected.

| Gate line | $T_{11}$ | $T_{12}$□□ □□ | Gate pulse |
|---|---|---|---|
| N | :G11 | G12 | GI |
| N + (Y/2) + n − 4 | :*G22 | *G23 | |
| N + (Y/2) + n − 2 | :*G24 | *G25 | |
| N + (Y/2) + n | :G26(G1) | G27(G2) | GB |

Only the gate lines G11 and G1 are selected in the time period $T_{11}$, and only the gate lines G12 and G2 are selected in the time period $T_{12}$.

During the time period $T_{13}$ and $T_{14}$ of the odd frame period, the following gate lines are selected.

| Gate line | $T_{13}$ | $T_{14}$□□ □□ | Gate pulse |
|---|---|---|---|
| N | :G13 | G14 | GI |
| N + (Y/2) + n − 4 | :*G24 | *G25 | |
| N + (Y/2) + n − 2 | :G26(G1) | G27(G2) | GB |
| N + (Y/2) + n | :G28(G3) | G29(G4) | GB |

Only the gate lines G13, G1 and G3 are selected in the time period $T_{13}$, and only the gate lines G14, G2 and G4 are selected in the time period $T_{14}$. In this manner, the gate lines of the remaining time periods can be selected.

Figure 13:
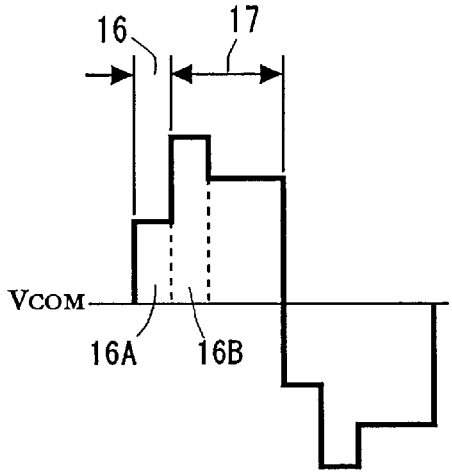
FIG. 13 shows alternative data signal which can be used in place of the data signal shown in the FIG. 9.

FIG. 13 shows an alternative data signal which can be used in place of the data signal shown in the FIG. 9. In the data signal shown in the FIG. 13, the black signal portion 16 for defining the full black color is divided into two subsections 16A and 16B. In the case that the leading edge of the black signal portion 16 is raised up to the full black level +VB or −VB, as shown in the FIGS.6, 9 and 10, an overshoot may be generated in which the rapidly raising black signal portion 16 overcharges the capacitor of the pixel at the write operation of the image to charge the capacitor to a voltage level larger than the desired image voltage level. It is possible to prevent the overshoot by reducing the absolute value, i.e. the amplitude, of the black signal portion 16 shown in the FIGS.6, 9 and 10 to a value which is smaller than the value of the full black voltage +VB or −VB. However, an undesired situation may arise in which the afterimage can not be sufficiently erased due to the decrease of the amplitude of the black signal portion 16, so that both the prevention of the overshoot and erase of the afterimage can not be performed. The black signal portion 16 divided into the two subsections 16A and 16B, shown in the FIG. 13, is effective in the case that such undesired situation arises, and can perform both the prevention of the overshoot and erase of the afterimage. More particularly, an absolute value of the voltage level of the subsection 16A is selected to a value which is smaller than the absolute value of the full black voltage level, +VB or −VB, of the subsection 16B to prevent the overshoot.

Figure 14:
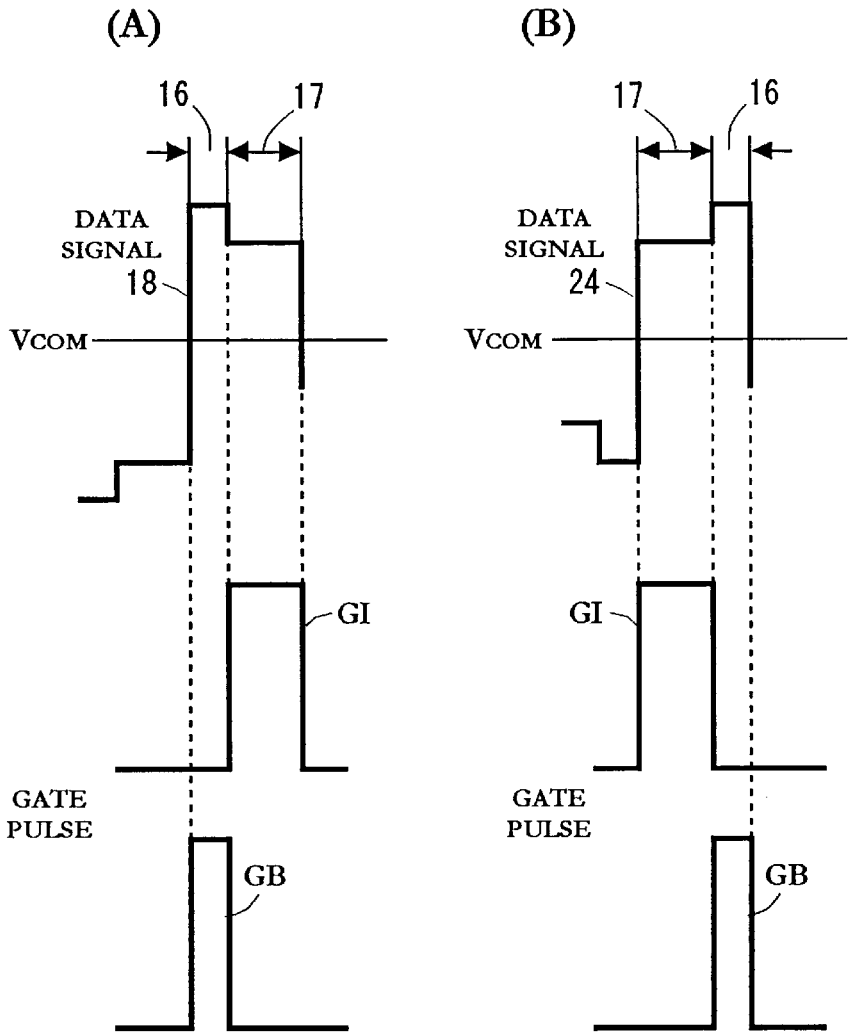
FIG. 14 shows an alternative gate pulse GI which can be used in place of the gate pulse GI shown in the FIG. 9.

FIG. 14 shows an alternative gate pulse GI which can be used in place of the gate pulse GI shown in the FIG. 9. The gate pulse GI shown in the FIG. 14(A) and (B) has a pulse width to gate only the image signal portion 17 of the data signals 18 and 24. Such gate pulse GI can be used in the case that the image signal portion 17 can sufficiently charge the capacitor of the pixel to a desired image voltage level within the time period of the gate pulse GI without the assistance of the bias action of the black signal portion 16. The gate pulse GB shown in the FIGS.14(A) and (B) gates the black signal portion 16 of the data signals 18 and 24 as in the case shown in the FIG. 10. In the FIG. 14(B), the image signal portion 17 is disposed in the front portion of the data signal 24 and is followed by the black signal portion 16, the gate pulse GI aligned to gate the image signal portion 17 and the gate pulse GB is aligned to gate the black signal portion 16.

Although the present invention has been described by using the liquid crystal display device as the example of the display device, the present invention can be used in another type display device, such as a plasma display device, a field emission display device, etc., which can simultaneously activates a plurality of gate lines.

Although the black color of the positive polarity (+B) is written after the image of the same positive polarity (+I), and the black color of the negative polarity (−B) is written to follow the image of the negative polarity (−I) in the write operation shown in the FIGS.7 and 8 and shown in the FIGS. 11 and 12, the black color of the negative polarity (−B) can be written after the image of the opposite polarity (+I), and the black color of the positive polarity (+B) can be written after the image of the opposite polarity (−I) for the reason that the human eyes of the user recognize the image and the black color irrespective of their polarity.

Although the write operation of the present invention has been described by using the LCD array having only 24 pixels in the horizontal direction and 20 pixels in the vertical direction for simplifying the description and the drawings, it is apparent that the write operation of the present invention can be applicable to the display device with the display surface which has the 640×480 pixels of the VGA scheme, the 800×600 pixels of the SVGA scheme, or the 1024×768 pixels of the XGA scheme, etc. Any voltage level which sufficiently erases the image of the preceding frame period can be used in place of the full black voltage level, +VB or −VB of the black signal portion 16. Although the delay between the start of the write operation of the image into the pixels and the start of the write operation of the black color in these pixels is selected to the F/2 in the case of the FIGS. 11 and 12, the value of this delay can be selected to any value which can prevent the display image from becoming unclear due to an overlap of the afterimage of the display image of the preceding frame period with the display image of the current frame period.

What is claimed is:

1. A display apparatus comprising:

a display surface having a plurality of pixels; and a write circuit adapted to sequentially write and image into each of said plurality of pixels, wherein said write circuit writes, during a time period for writing said image into at least one pixel, a black color into another pixel sharing a common data line with the at least one pixel, wherein a gate pulse for writing the image and a gate pulse for writing the black color have the same polarity.

2. A display apparatus according to claim 1, wherein said another pixel line is separated from said at least one pixel line by a predetermined distance.

3. A display apparatus according to claim 2, wherein said write circuit writes said black color into a plurality of pixel lines separated from said at least one gate line by said predetermined distance.

4. A display apparatus comprising:

a display surface having a plurality of data lines arranged along one direction and a plurality of gate lines arranged along the other direction crossing said one direction, wherein one picture element is formed at each one of cross points of said data lines and said gate lines;

a data line drive circuit adapted to supply a data signal, which includes a black color signal portion and an image signal portion, to each of said plurality of data lines; and a gate line drive circuit adapted to sequentially supply a gate pulse to each of said plurality of gate lines;

wherein said gate line drive circuit supplies, during a write period for writing said data signal, a wide gate pulse, which gates both the black color signal portion and image signal portion of said data signal, to at least one gate line, and a narrow gate pulse, which gates said black color signal portion of said data signal, to another gate line.

5. A display apparatus according to claim 4, wherein said another gate line is separated from said at least one gate line by a predetermined distance.

6. A display apparatus according to claim 5, wherein said black color signal portion is included in a front portion of said data signal.

7. A display apparatus according to claim 6, wherein said gate line drive circuit supplies said narrow gate pulse to a plurality of gate lines which are separated from said at least one gate line by said predetermined distance.

8. A display apparatus comprising:

a display surface having a plurality of data lines arranged in one direction and a plurality of gate lines arranged in the other direction crossing said one direction, wherein one picture element is formed at each of cross points of said data lines and said gate lines;

a data line drive circuit adapted to supply a data signal, which includes a black color signal portion and an image signal portion, to each of said plurality of data lines; and a gate line drive circuit adapted to sequentially supply a gate pulse to each of said plurality of gate lines;

wherein said gate line drive circuit supplies, during a write period for writing said data signal, a first gate pulse, which gates said image signal portion of said data signal, to at least one gate line, and a second gate pulse, which gates said black color signal portion of said data signal, to another gate line.

9. A display apparatus according to claim 8, wherein said another gate line is separated from said at least one gate line by a predetermined distance.

10. A display apparatus according to claim 9, wherein said black color signal portion is included in a front portion of said data signal.

11. A display apparatus according to claim 9, wherein said image signal portion is included in a front portion of said data signal.

12. A display apparatus according to claim 10 or 11, wherein said gate line drive circuit supplies said second gate pulse to a plurality of gate lines which are separated from said at least one gate line by a predetermined distance.

13. A display apparatus comprising:

a display surface having a plurality of data lines arranged in one direction and Y gate lines arranged in the other direction crossing said one direction, wherein said Y is an integer equal to or larger than 1, one pixel is formed at each of cross points of said data lines and said gate lines, and a plurality of pixels along each of said Y gate lines form one pixel line;

a data line drive circuit adapted to supply a data signal, which includes a black color signal portion and an image signal portion, to each of said plurality of data lines; and a gate line drive circuit adapted to sequentially supply a gate pulse to each of said Y gate lines;

wherein said gate line drive circuit supplies, during a write period for writing said data signal, a wide gate pulse, which gates both the black color signal portion and image signal portion of said data signal, to at least one gate line, and a narrow gate pulse, which gates said black color signal portion of said data signal, to another gate line separated from said at least one gate line; said gate line drive circuit sequentially supplies said wide gate pulse to each of said Y gate lines during a frame period including a time periods $T_1$ through $T_N$, wherein the N is 1 through Y; one frame period and next frame period are separated by a blanking period; and said black color signal portion is written, during said blanking period, into at least one pixel line which succeeds to the pixel line into which said black color is written during the last time period $T_N$ in said one frame.

14. A display apparatus according to claim 13, wherein a polarity of said data signal supplied to each pixel line is alternately inverted in successive frame periods; said blanking period includes even time periods $T_{B1}$ through $T_{BE}$, each of which has a length equal to each of said time periods $T_1$ through $T_N$; and said polarity of said data signal is adjusted, during said blanking period, to provide the data signal with a polarity which is opposite to that of the data signal supplied in a preceding frame period.

15. A display apparatus according to claim 13, wherein a polarity of said data signal supplied to each pixel line is alternately inverted in successive frame periods; said blanking period includes odd time periods $T_{B1}$ through $T_{B0}$ each of which has a length equal to each of said time periods $T_1$ through $T_N$; and said black color signal portion is written, during said blanking period, into the pixel lines equal to the number of said odd time periods $T_{B1}$ through $T_{B0}$ during said blanking period.

16. A display apparatus according to claim 14 or 15, wherein said black color signal portion is included in a front portion of said data signal.

17. A display apparatus according to claim 16, wherein said gate line drive circuit supplies said narrow gate pulse to a plurality of gate lines which are separated from said at least one gate line by said predetermined distance.

* * * * *